US011975913B2

(12) United States Patent
Schnakenberg et al.

(10) Patent No.: US 11,975,913 B2
(45) Date of Patent: May 7, 2024

(54) PACKET FOR PRODUCTS IN THE CIGARETTE INDUSTRY, AND METHOD AND DEVICE FOR PRODUCING THE SAME

(71) Applicant: Focke & Co. (GmbH & Co. KG), Verden (DE)

(72) Inventors: Jan Schnakenberg, Blender-Amedorf (DE); Gerd Städing, Marklohe (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 275 days.

(21) Appl. No.: 17/438,513

(22) PCT Filed: Mar. 9, 2020

(86) PCT No.: PCT/EP2020/056251
§ 371 (c)(1),
(2) Date: Sep. 30, 2021

(87) PCT Pub. No.: WO2020/187632
PCT Pub. Date: Sep. 24, 2020

(65) Prior Publication Data

US 2022/0144536 A1 May 12, 2022

(30) Foreign Application Priority Data

Mar. 15, 2019 (DE) ..... 102019106619.0

(51) Int. Cl.
*B65D 85/10* (2006.01)
*B65B 9/067* (2012.01)
(Continued)

(52) U.S. Cl.
CPC ..... *B65D 85/10568* (2020.05); *B65B 9/067* (2013.01); *B65B 19/025* (2013.01); *B65B 51/16* (2013.01)

(58) Field of Classification Search
CPC ..... B65B 51/16; B65B 19/025; B65B 9/067; B65D 85/10568
(Continued)

(56) References Cited

U.S. PATENT DOCUMENTS 2,096,063 A 10/1937 Reynolds
2,262,774 A 11/1941 Neumar
(Continued)

FOREIGN PATENT DOCUMENTS

CA 2255560 A1 * 11/1998
CA 2255560 A1 11/1998
(Continued)

OTHER PUBLICATIONS

WIPO, International Search Report (in a related application), dated Sep. 4, 2020.
(Continued)

*Primary Examiner* — Rafael A Ortiz
(74) *Attorney, Agent, or Firm* — Laurence P. Colton; Smith Tempel Blaha LLC

(57) ABSTRACT

A packet for cigarette industry products, having a casing which, preferably on all sides, surrounds a group of cigarette industry products as the packet content, wherein the casing is formed from a packaging material, and wherein folding tabs of the packaging material are connected to one another by seams. Preferably all seams are formed by crimping folding tabs of the packaging material that bear on one another in the overlap region of those folding tabs that bear on one another. The invention also relates to corresponding devices and methods for producing such packets.

16 Claims, 11 Drawing Sheets

(51) Int. Cl.
*B65B 19/02* (2006.01)
*B65B 51/16* (2006.01)

(58) Field of Classification Search
USPC ..... 206/273, 242
See application file for complete search history.

(56) References Cited

U.S. PATENT DOCUMENTS

| | | | | |
|---|---|---|---|---|
| 8,627,951 | B2 * | 1/2014 | Buse | B65D 75/5838 206/268 |
| 10,766,688 | B2 * | 9/2020 | Buse | B65B 61/02 |
| 2003/0223653 | A1 | 12/2003 | Knoerzer | |
| 2012/0058231 | A1 * | 3/2012 | Hatinger | B65D 75/5827 426/123 |
| 2015/0027916 | A1 * | 1/2015 | Buse | B65B 9/06 206/268 |
| 2016/0368645 | A1 * | 12/2016 | Buse | B65B 61/184 |
| 2018/0334316 | A1 * | 11/2018 | Buse | B65D 85/10568 |
| 2018/0346235 | A1 * | 12/2018 | Buse | B65D 75/5838 |
| 2019/0185252 | A1 * | 6/2019 | Häfker | B65D 85/10568 |

FOREIGN PATENT DOCUMENTS

| | | | | |
|---|---|---|---|---|
| CA | 2255560 | A1 * | 5/2000 | A63B 69/201 |
| DE | 1486177 | A1 | 1/1969 | |
| DE | 19837469 | A1 | 2/2000 | |
| DE | 102011119344 | A1 | 4/2013 | |
| DE | 102013009470 | A1 | 12/2014 | |
| DE | 102016007533 | A1 | 12/2017 | |
| GB | 266560 | A | 3/1927 | |
| GB | 677659 | A | 8/1952 | |
| JP | S57101791 | U | 6/1982 | |
| WO | 9849072 | A1 | 11/1998 | |
| WO | 9929593 | A1 | 6/1999 | |
| WO | 2008090071 | A1 | 7/2008 | |
| WO | WO-2017097388 | A1 * | 6/2017 | B65B 19/025 |
| WO | 2018078581 | A1 | 5/2018 | |

OTHER PUBLICATIONS

Deutsches Patent—Und Markenamt (German Patent and Trademark Office), Recherchebericht (search in a related application), Nov. 27, 2019.

* cited by examiner

*Fig. 10*
*Fig. 11*
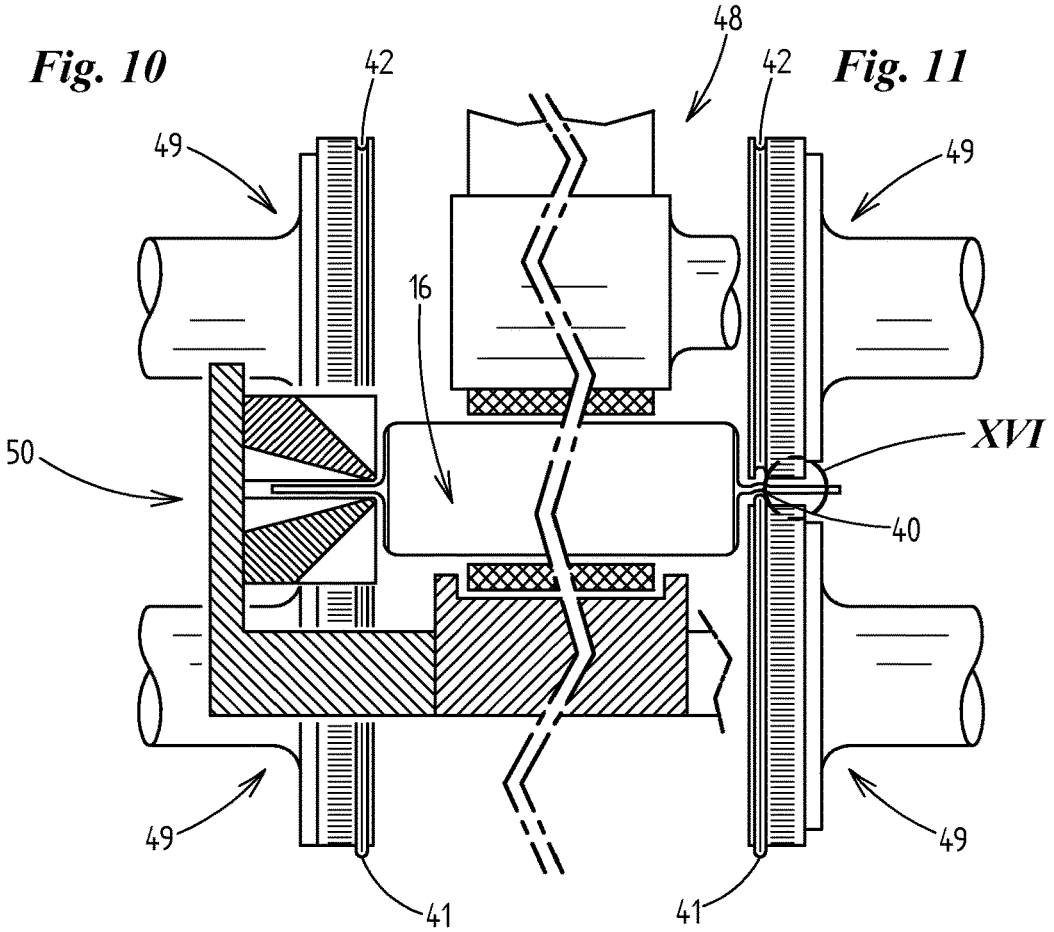
*Fig. 12*
*Fig. 13*
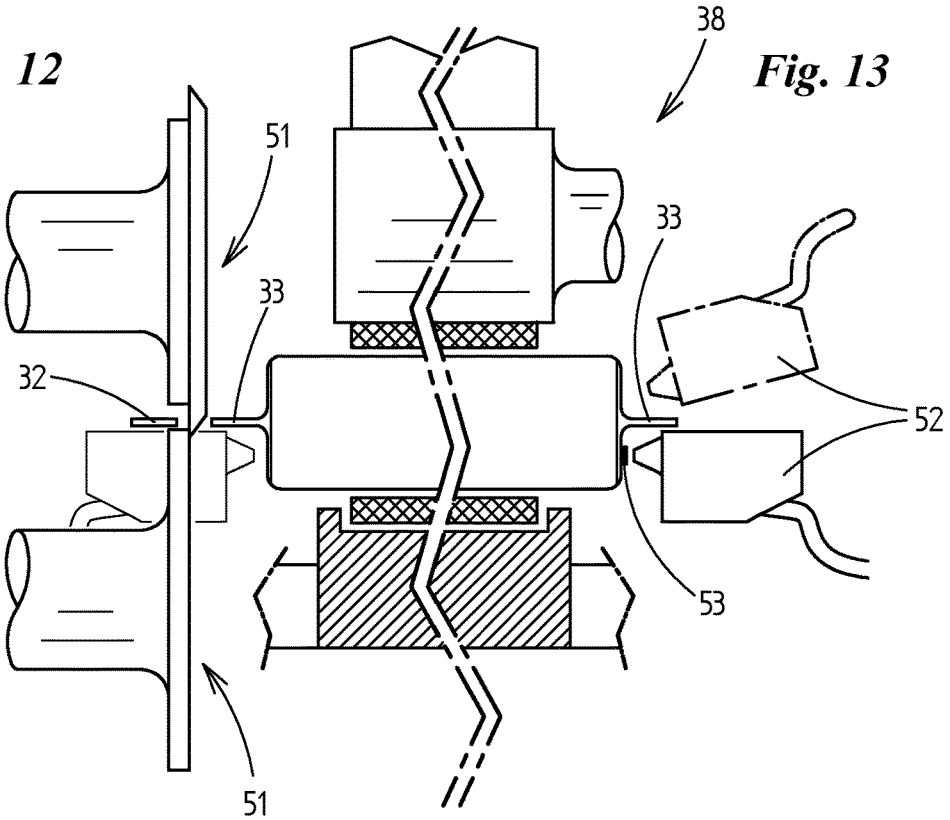

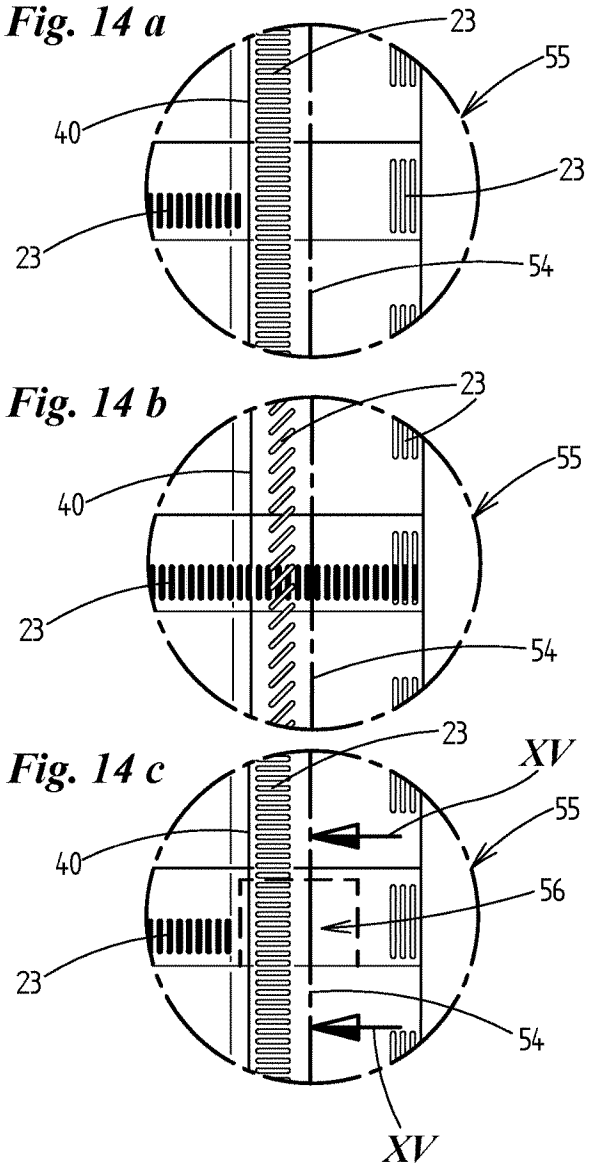
Fig. 14 a
Fig. 14 b
Fig. 14 c
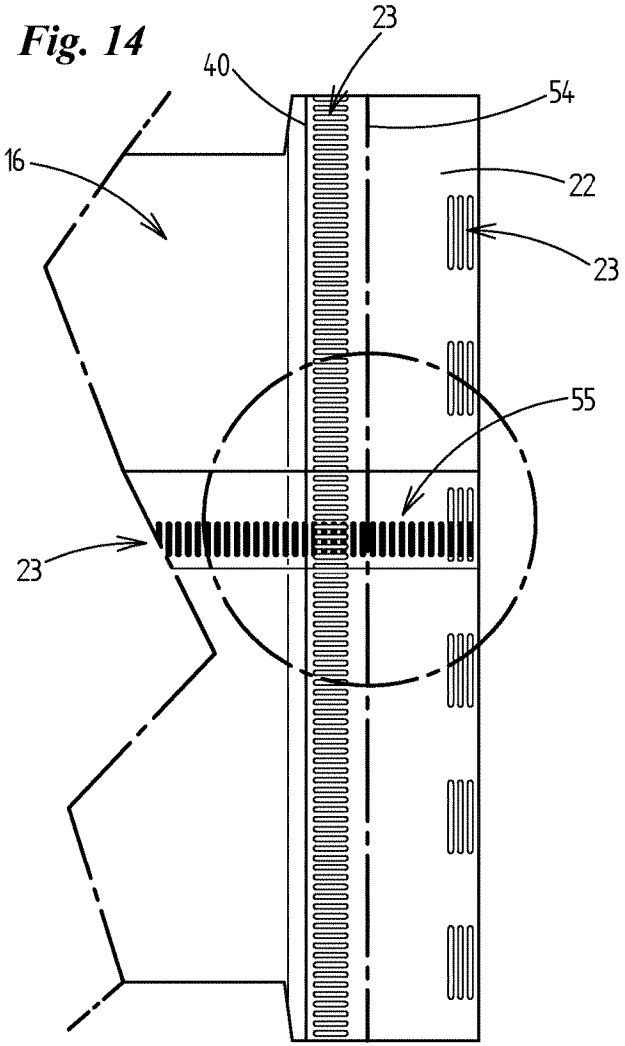
Fig. 14

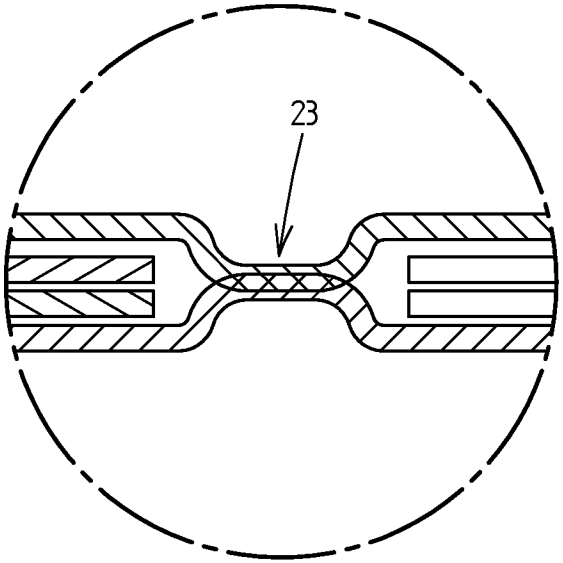
Fig. 16
Fig. 15
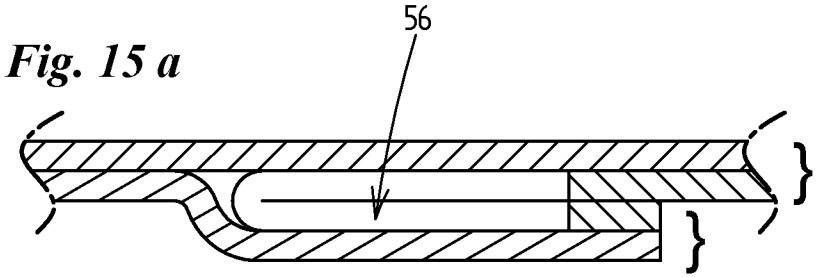
Fig. 15 a
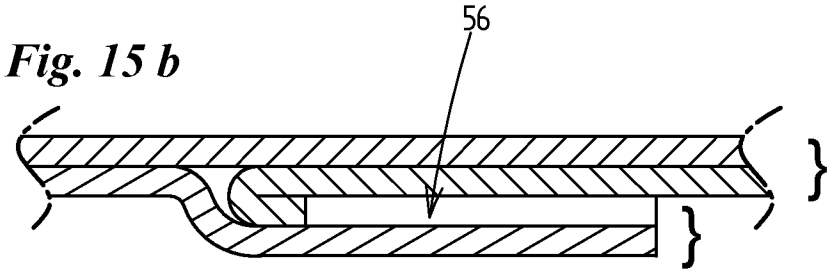
Fig. 15 b

PACKET FOR PRODUCTS IN THE CIGARETTE INDUSTRY, AND METHOD AND DEVICE FOR PRODUCING THE SAME

CROSS REFERENCE TO RELATED APPLICATIONS

This application is the US National Phase of and claims the benefit of and priority on International Application No. PCT/EP2020/056251 having a filing date of 9 Mar. 2020, which claims priority on and the benefit of German Patent Application No. 10 2019 106 619.0 having a filing date of 15 Mar. 2019.

BACKGROUND OF THE INVENTION

Technical Field

The invention relates to a packet for cigarette industry products, having a casing which, preferably on all sides, surrounds a group of cigarette industry products as the packet content, preferably on all sides, wherein the casing is formed from a packaging material, and wherein folding tabs of the packaging material are connected to one another by seams.

The invention furthermore relates to a method for producing packets for cigarette industry products, wherein a group of cigarette industry products as the packet content is encased, preferably on all sides, in a packaging material, and wherein folding tabs of the packaging material are connected to one another by forming seams.

The invention also relates to a device for producing packets for cigarette industry products, wherein a group of cigarette industry products as the packet content is encased, preferably on all sides, in a packaging material, and wherein folding tabs of the packaging material are connected to one another by forming seams.

Prior Art

The production of packets of cigarettes is known from practice, wherein a group of cigarettes is disposed in a casing from a sealing-capable film material and the film material is closed by forming seams in order to create a so-called tight block in which the cigarettes can be safely stored. It is known here for the seams to be formed or closed, respectively, by sealing plies of the film material. It is furthermore known that the seams can be sealed in relation to the cigarette group by sealing overlapping folding tabs of the film material, or as so-called fin seams without the pressure required during sealing acting on the mutually overlapping plies of the film material on the cigarette group.

Packets of this type have been successful in principle. However, in some markets or countries there are provisions that regulate the materials with which the cigarettes, as the packet content, may come into contact. In particular, in such countries it is not allowed for the cigarettes to come into contact with coated materials and/or sealing media (e.g., varnishes, glues, adhesives, etc.). The use of known packets of the type mentioned at the outset is thus not possible, and/or only possible to a limited extent, in such countries.

BRIEF SUMMARY OF THE INVENTION

Proceeding therefrom, the invention is based on the object of refining packets of the type mentioned at the outset, in particular with a view to at least partially eliminating the problems present in the prior art, but at least with a view to achieving further embodiments. The invention is furthermore based on the object of proposing suitable methods and devices for producing such packets.

A packet for achieving this object is a packet for cigarette industry products, having a casing which, preferably on all sides, surrounds a group of cigarette industry products as the packet content, wherein the casing is formed from a packaging material, and wherein folding tabs of the packaging material are connected to one another by seams, characterized in that preferably all the seams are formed by crimping folding tabs of the packaging material that bear on one another in the overlap region of those folding tabs that bear on one another. Accordingly, it is provided that preferably all the seams are formed by crimping folding tabs of the packaging material that bear on one another in the overlap region of those folding tabs that bear on one another.

It has been somewhat surprisingly demonstrated that, by crimping preferably all seams, a casing can be formed which can meet the requirements that are nowadays placed on the packaging of cigarette industry products.

This procedure also has the advantage that the use of coated materials or sealing media can be at least largely dispensed with. The production of the packets is thus simpler, more cost-effective and more environmentally friendly. In particular, there is no need for heat for sealing the seams to be introduced. Furthermore, recycling is simplified, since it is no longer necessary to use mixtures of materials that are difficult to separate.

It can preferably be provided that preferably all seams are formed exclusively by crimping.

Furthermore, it can be provided that the seams that are formed by crimping are configured as fin seams.

The casing can have a large-area front side, a corresponding, opposite, large-area rear side, narrow sides which connect the front side and the rear side, as well as a base side and an opposite end side, wherein the base side and the end side are in each case adjacent to the front side, the rear side and the narrow sides.

It can preferably be provided that a seam, in particular a transverse seam of the casing, runs across the front side or the rear side of the casing so as to be directed transversely to a longitudinal axis of the casing.

Furthermore, it can be provided that a seam, in particular a longitudinal seam of the casing, runs in each case along the narrow sides of the casing so as to be parallel to a longitudinal axis of the casing.

In particular, it can be provided that seams, in particular longitudinal seams, are folded in the region of narrow sides of the casing in the direction of a front side or a rear side in the region of narrow sides of the casing are folded in the direction of a front side or a rear side of the casing.

It can preferably be provided that, in casings having seams folded in the direction of a front side, the packet in the region of narrow sides of the casing does not have a collar and the folded-over seams are fastened to the casing by adhesive bonding, in particular in order to avoid a collision between a lid of the packet and the folded-over seams when closing the lid.

A particularity can lie in that a groove in the overlap region of the packaging material is applied parallel to one or each seam.

This solution can in particular have the advantage that, when seams are being folded over, the overlap region having the seam is exposed to lower forces as a result of the groove. This has a positive effect on the durability of the seam formed by crimping.

It can preferably be provided that the groove extends parallel to a neighboring seam and is disposed on that side of the neighboring seam that faces the package content.

Furthermore, it can be provided that the seams are disposed in such a manner that the number of folding tabs that bear on one another in the overlap region and are to be connected to one another by crimping is limited, preferably to fewer than 5 plies and most preferably to fewer than 4 plies.

It has been demonstrated that the number of plies to be connected by crimping is limited. To this extent, measures are required to adapt the number of overlapping plies so that the seams are formed in an orderly manner.

Furthermore, it can be provided that seams having an intersecting profile in an intersection region of the seam profile at least in part have an interruption in one or a plurality of seams such that the seams do not overlap in the intersection region.

One potential solution can be that a recess for reducing the number of plies in the overlap region is formed in the packaging material in an overlap region of the packaging material, and that the recess is disposed in the intersection region such that the seams do not overlap in the intersection region.

Alternatively, it can be provided that, in an overlap region of the packaging material, the crimp is interrupted along a portion of a seam, and that this interruption of the crimp is disposed in the intersection region such that the crimps do not overlap in the intersection region.

It is furthermore possible that the crimp is modified in an overlap region of the packaging material, in particular in terms of a density of the crimp and/or an alignment of the crimp, and that a correspondingly modified portion of the crimp is disposed in the intersection region.

It is also conceivable that the crimp is disposed in such a manner that said crimp does not intersect the or each groove applied in the packaging material, in particular such that the crimp ends before the or each groove and is interrupted in the region of the or each groove.

Another particularity can lie in that the regions of the packaging material that face the packet contents are composed exclusively of paper, or that the packaging material is composed exclusively of paper.

It is preferably provided that the group of tobacco industry products encased in the packaging material forms an inner packet which finds a receptacle in an outer packet, wherein the outer packet is preferably configured as a hinge-lid packet.

A method for achieving the object mentioned at the outset is a method for producing packets for cigarette industry products, wherein a group of cigarette industry products as the packet content is encased, preferably on all sides, in a packaging material, and wherein folding tabs of the packaging material for closing the casing made from packaging material thus formed are connected to one another by forming seams, characterized in that preferably all the seams are formed by crimping folding tabs of the packaging material that bear on one another in the overlap region of those folding tabs that bear on one another. Accordingly, it is provided that preferably all seams are formed by crimping folding tabs of the packaging material that bear on one another in the overlap region of the folding tabs that bear on one another.

It can preferably be provided that the group of products is fed along a packet path and at least partially encased in a running material web made from packaging material, and that a continuous seam for connecting two folding tabs of the material web is formed parallel to the transport direction by crimping, said seam preferably being directed so as to be transverse to a longitudinal axis of the group of products.

Furthermore, it can be provided that subsequently the running material web is severed between two successive groups of products, wherein, preferably at the same time, at least one provisional seam which runs so as to be directed transversely to the transport direction, preferably parallel to a longitudinal axis of the groups of products, is formed by crimping.

In particular, preferably together with the separation cut, a provisional seam between successive groups of products is in each case formed on both sides of the separation cut by crimping.

Furthermore, it can be provided that final seams which run so as to be parallel to the provisional seams, but are disposed closer to the group of products than the previously applied provisional seams, are formed by crimping.

Furthermore, it can be provided that the regions of the packaging material that protrude outward in relation to the final seams are severed by the provisional seams.

Furthermore, it can be provided that the final seams that are formed as fin seams are folded.

Furthermore, it can be provided that corner areas of the packaging material are folded in the transition from narrow sides to the end side and in the transition from narrow sides to the base side.

Furthermore, it can be provided that, preferably simultaneously with the application of one or each seam, a groove for the later folding of the overlap region along the groove is applied in the overlap region.

Furthermore, it can be provided that the overlap regions that are folded along the groove are fastened to the blank by means of adhesive bonding.

A device for achieving the object mentioned at the outset is a device for producing packets for cigarette industry products, wherein a group of cigarette industry products as the packet content is encased, preferably on all sides, in a packaging material, and wherein folding tabs of the packaging material are connected to one another by forming seams, characterized in that, by means of a crimping device, preferably all seams are formed by crimping folding tabs of the packaging material that bear on one another in the overlap region of those folding tabs that bear on one another. Accordingly, it is provided that, by means of a crimping device, preferably all seams are formed by crimping folding tabs of the packaging material that bear on one another in the overlap region of the folding tabs that bear on one another.

Furthermore, it can be provided that the crimping device has two crimping rollers which are disposed on different sides of the folding tabs of the packaging material to be connected and between which the multi-ply packaging material is guided through for applying the crimp, wherein the crimping rollers on the mutually facing circumferential faces for applying the crimp have corresponding crimping protrusions and crimping depressions.

Furthermore, it can be provided that at least one crimping roller has a portion in the region of which the crimping protrusions and crimping depressions are interrupted so as to generate interruptions in the profile of the crimp.

Furthermore, it can be provided that at least one crimping roller, in addition to the crimping protrusions and/or crimping depressions, has means for simultaneously applying a groove on the packaging material, in particular a preferably circumferential groove protrusion and/or a corresponding groove depression.

Further preferred particulars and details of the invention are furthermore derived from the drawings and the description hereunder.

BRIEF DESCRIPTION OF THE DRAWINGS

Preferred exemplary embodiments of the invention will be described hereunder by means of the drawings, in which:

FIG. 10 shows a vertical section through the device according to FIG. 9 along the section line X-X in FIG. 9;

FIG. 11 shows a vertical section through the device according to FIG. 9 along the section line XI-XI in FIG. 9;

FIG. 12 shows a vertical section through the device according to FIG. 9 along the section line XII-XII in FIG. 9;

FIG. 13 shows a vertical section through the device according to FIG. 9 along the section line XIII-XIII in FIG. 9;

FIG. 14 shows an enlarged detail of the packet;

FIGS. 14*a* to *c* show different solutions in terms of the configuration of the overlap region of seams;

FIGS. 15*a* and *b* show vertical sections through the seams in two different variants;

FIG. 16 shows a vertical section through a seam in the region of the crimp;

DETAILED DESCRIPTION OF PREFERRED EMBODIMENTS

The invention will be explained hereunder by means of packets 10 for cigarettes 11. It is understood that the packets 10 are also suitable for other cigarette industry products.

In the context of the application, cigarette industry products are understood to mean tobacco products such as cigarettes, cigarillos and the like, or else novel tobacco products such as heat-not-burn products or liquid carriers for e-cigarettes, for example.

Figure 2:
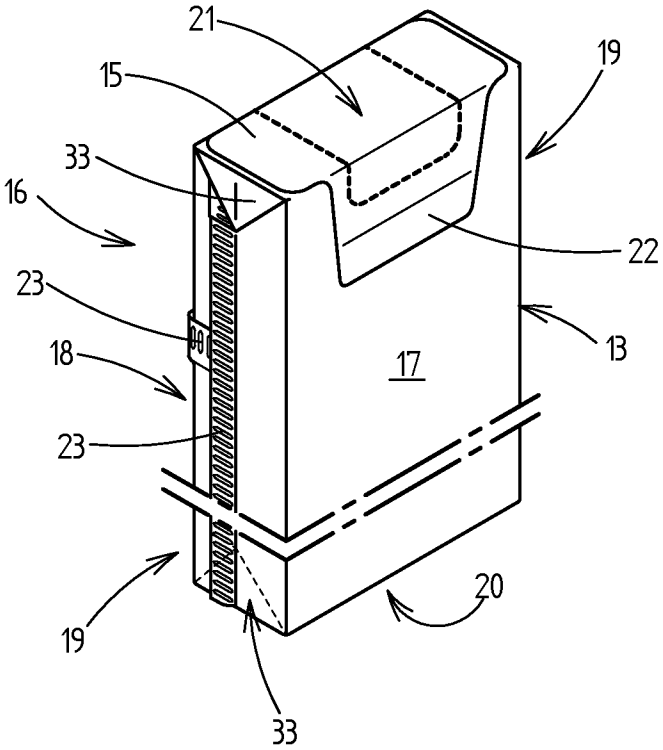
FIG. 2 shows a group of cigarettes in a casing.
Figure 1:
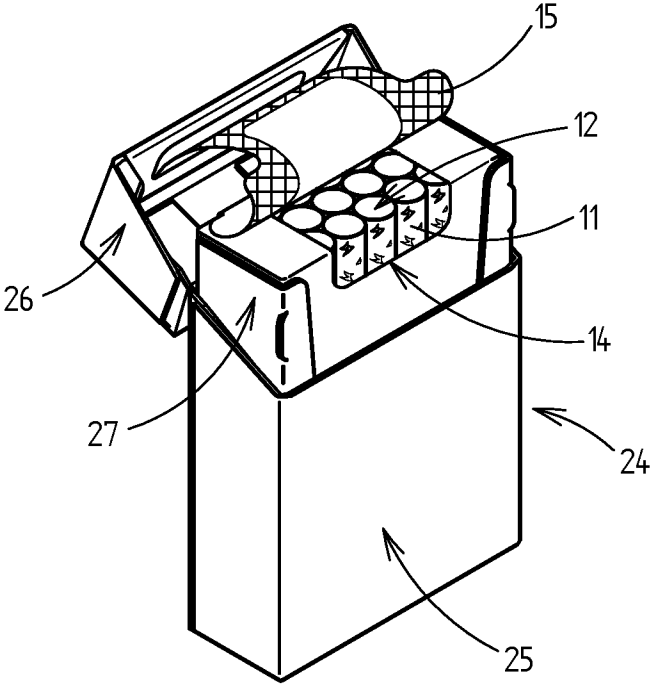
FIG. 1 shows a packet for cigarettes, with an opened lid.

In the case of the packet 10 shown in FIGS. 1 and 2, a group 12 of cigarettes 11 is provided as the packet content. The group 12 is encased in a casing 13 from a packaging material. A retrieval opening 14 is able to be closed by a closure means 15 which is able to be activated multiple times.

This inner packet 16 or casing 13, respectively, has a large-area front side 17, a corresponding, opposite, large-area rear side 18, as well as narrow sides 19 which connect the front side 17 and the rear side 18 to one another. Furthermore provided are a base side 20 and an end side 21 which are in each case adjacent to the front side 17, the rear side 18 and the narrow sides 19.

The closure means 15 extends almost across the entire end side 21 and by way of an end region is fastened to the rear side 18. Another end of the closure means 15 extends into the region of the front side 17. The closure means 15 covers the retrieval opening 14 on all sides. Provided at a lower end of the closure means 15 is a folding tab 22 which serves for opening the closure means 15.

During the production of the packet 10, the casing 13 is wrapped around the group 12 and closed by forming seams 23. Usually, a plurality of plies of the packaging material are connected to one another here.

In the present case, it is provided that folding tabs of the packaging material are brought to bear on one another in the region of the two narrow sides 19 and are connected to one another by a seam 23 in the overlap region. This takes place in an analogous manner in the region of the rear side 18 of the casing 13.

FIG. 2 shows that the seams 23 in the region of the narrow sides 19 are folded over after the folding tabs of the packaging material have been connected, and are placed against the narrow sides 19, wherein the seams 23 are folded in the direction of the rear side 18.

A closed casing 13 in which the packet content is protected from harmful influences is formed by the seams 23. In the region of the retrieval opening 14, the casing 13 is closed by the closure means 15.

The inner packet 16 or casing 13, respectively, according to FIG. 2 can find a receptacle in an outer packet 24 according to FIG. 1. In the present case, the outer packet 24 is designed as a hinge-lid packet having a box part 25 and a lid 26 pivotably disposed thereon. Furthermore, the outer packet 24 can have a collar 27.

Of course, it can also be provided that the outer packet 24 is of a different construction. It is also conceivable that the outer packet 24 is absent. In this case, the terms packet 10, casing 13 and inner packet 16 are to be used synonymously.

In order for the closure means 15 of the inner packet 15 to be opened, the folding tab 22 is fastened to an internal side of a front wall of the lid 26, for example by adhesive bonding. In this way, the closure means 15 is automatically opened when opening the lid 26 and automatically closed when closing the lid 26. Alternatively, it is conceivable, for example, that the closure means 15 of the inner packet 16 is opened and closed manually, for example by the consumer grasping the folding tab 22.

Figure 3:
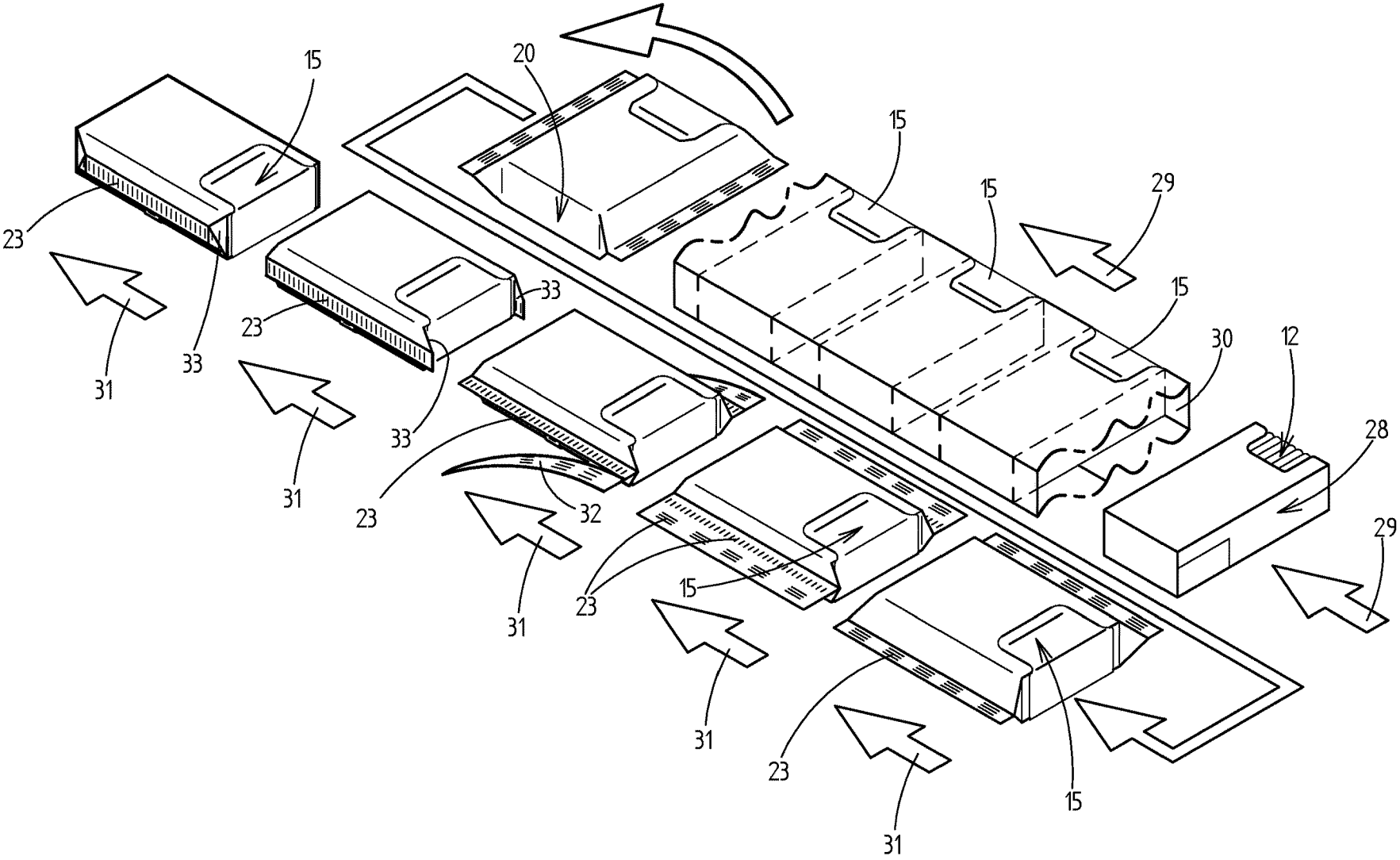
FIG. 3 shows a schematic illustration of the production process for the casing according to FIG. 2.

FIG. 3 shows the substantial parts of the sequence of packaging process:

The group 12 of cigarettes 11 is disposed here in a tray 28 from packaging material, wherein the tray 28 surrounds the group 12 on a plurality of sides. The tray 28 can be formed from a stiff packaging material such as thick paper or cardboard.

The group 12 having the tray 28 is transported by way of a longitudinal extension being transversely to the transport direction according to the arrow 29 and is encased in a tubular manner in a material web 30 from the packaging material. The individual groups 12 having the tray 28 within the tube of the material web 30 are disposed at a mutual spacing. A continuous seam 23 which extends parallel to the transport direction according to the arrow 29 and runs in the region of the later rear side 18 of the inner packet 16 is then formed. This seam 23 hereunder is also referred to as a transverse seam because the latter extends so as to be transverse to the longitudinal extension of the inner packet 16.

In the next step, the material web 30 is split up between the individual groups 12 and singularizing is thus carried out. Seams 23 which run so as to be directed transversely to the transport direction according to the arrow 29 are also formed here. These seams 23 are situated in the region of the narrow sides 19 of the inner packet 16 and hereunder are also referred to as longitudinal seams because the extent of said seams 23 runs so as to be directed parallel to the longitudinal axis of the inner packets 16.

In the next step, the singularized inner packets 16 are rotated by 90° and transported with the base side 20 first in the transport direction along the arrow 31. Correspondingly, the transverse seams of the inner packets 16 now point transversely to the transport direction according to the arrow 31 and the longitudinal seams point parallel to the transport direction according to the arrow 31.

Longitudinal seams which are disposed closer to the group 12 than the longitudinal seams applied first are then applied in the region of the narrow sides 19. The longitudinal seams that are applied first are therefore also referred to as provisional longitudinal seams, in contrast to the final longitudinal seams that are then applied later.

The provisional longitudinal seams are then separated by severing material strips 32 and the regions of the final longitudinal seams are turned over or folded over, respectively, and placed against the narrow sides 19. Finally, regions of the packaging material that protrude beyond the narrow sides, or the base side 20 or the end side 21, respectively, are also folded. These regions can be referred to colloquially as ears 33. The ears 33 can either be folded over as shown in FIG. 2 in the region of the end side 21. It is also conceivable that the ears 33, as shown in the region of the base side 20 in FIG. 2, are inserted or injected between the group 12 and the casing 13.

Figures 4, 5:
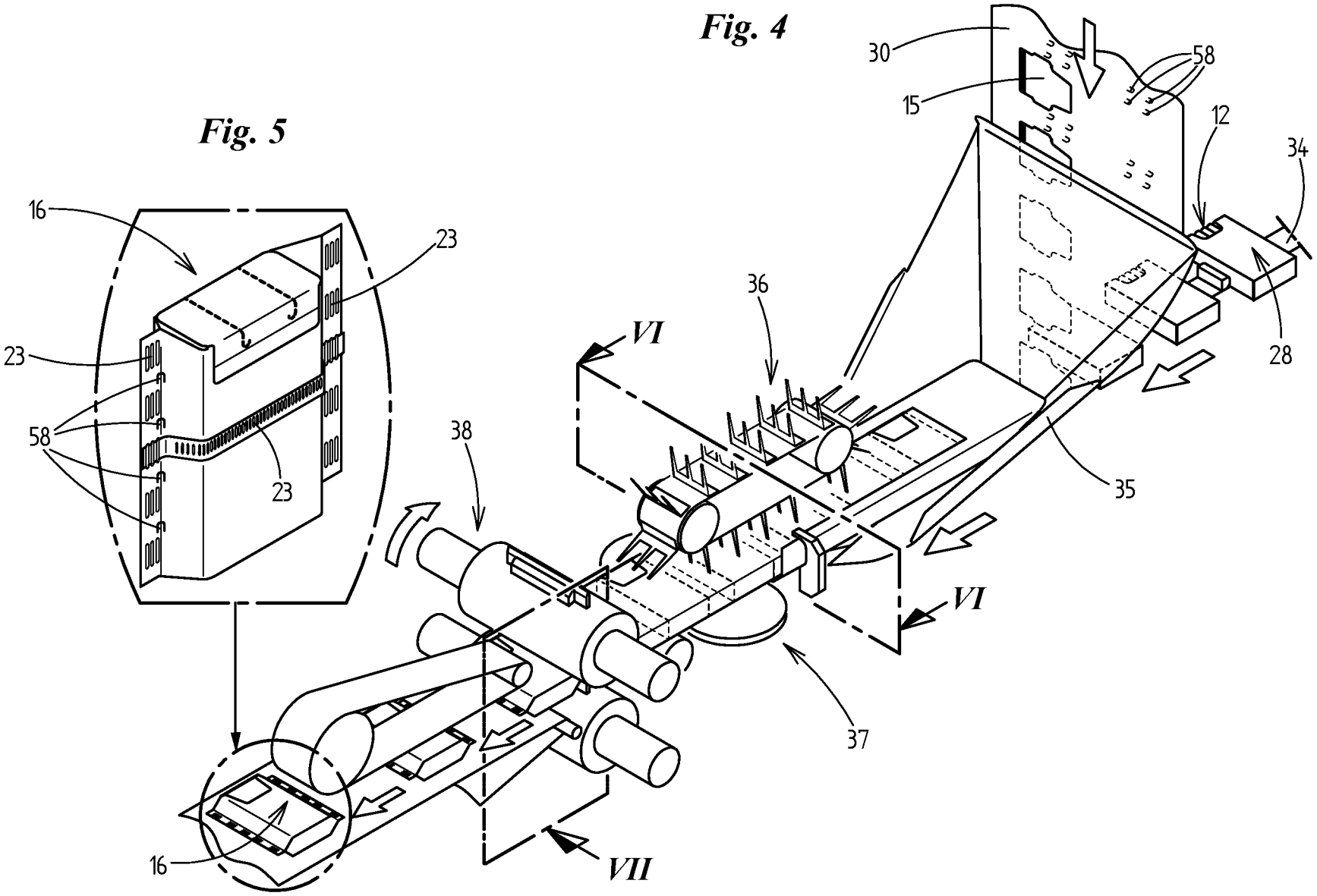
FIG. 4 shows a more detailed illustration of a first portion of the production process.
FIG. 5 shows an intermediate product of the first portion of the production process.

FIG. 4 shows a first part of the implementation of the production method in terms of plant engineering. The groups 12 having the tray 28 are transported lying on a conveying installation 34 and encased in the running material web 30 which for this purpose is guided around the groups 12 via a forming shoulder 35.

The material web 30 is smoothed on the upper side by a contact pressure element 36. On the underside, folding tabs of the material web 30 by a crimping device 37 are connected to form a running seam 23 which forms the transverse seam on the packets 10.

In a subsequent separating station 38, the transversely directed separation cuts are made between the groups 12, and the provisional seams 23 are applied as longitudinal seams. The singularized inner packets 16 are then transported away. The intermediate product of these first steps is shown in FIG. 5. Ventilation holes 58 which are provided in the region of the longitudinal seams can furthermore be seen here. The ventilation holes 58 are already contained in the infed material web 30 (see FIG. 4) and allow the air still present in the casing 13 to be discharged before the final longitudinal seams are applied.

Figure 6:
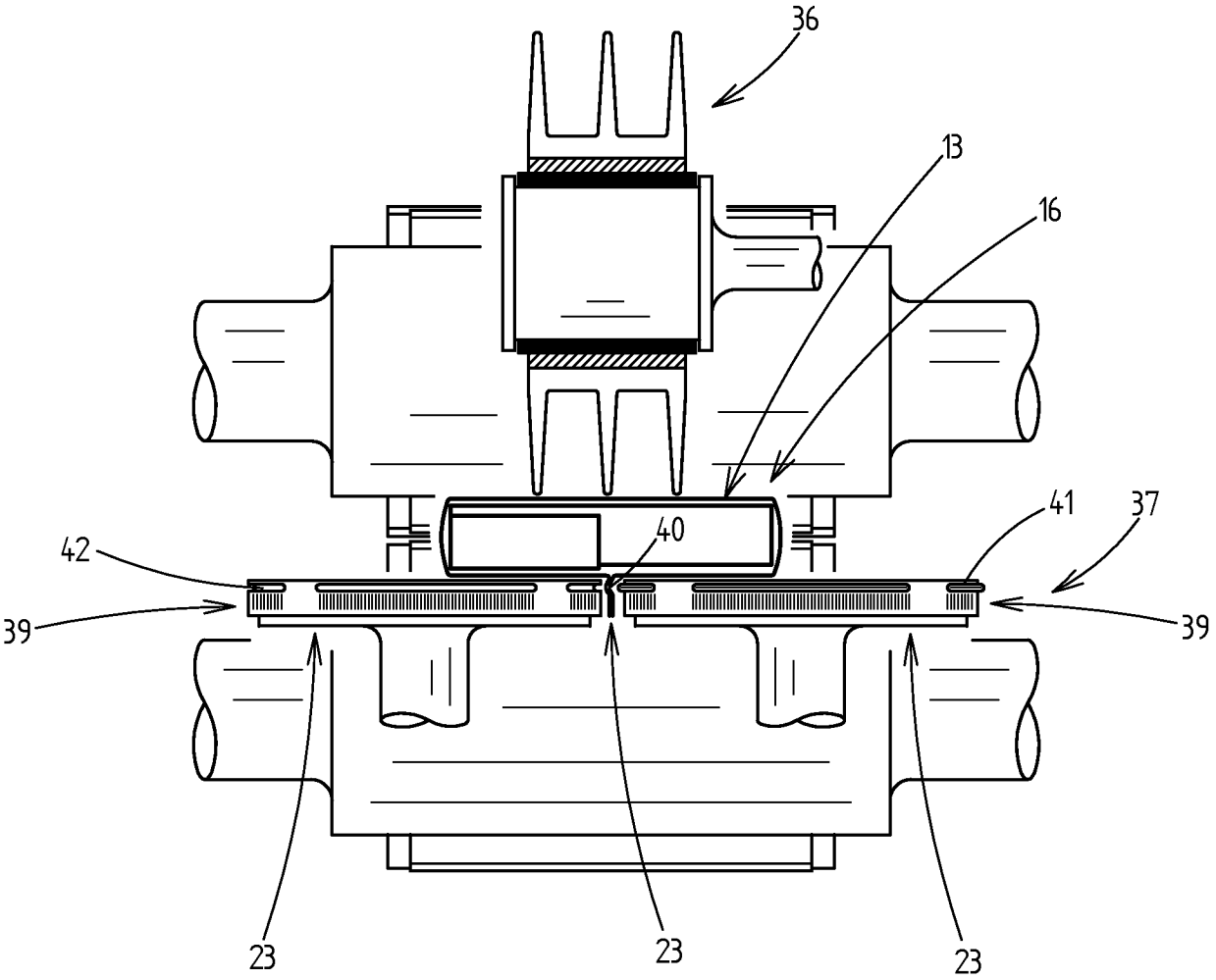
FIG. 6 shows a vertical section through the device according to FIG. 4 along the section line VI-VI in FIG. 4.

The mode of operation of the crimping device 37 can be readily seen from FIG. 6. Two crimping rolls 39 serve to form the seam 23 or the transverse seam, respectively. Corresponding crimping protrusions or crimping depressions, respectively, are disposed on the circumference of the two crimping rolls 39 and act on the folding tabs 22 to be connected such that the seam 23 is formed by crimping the packaging material.

The seam 23, like all seams of the inner packet 16, is configured as a fin seam and thus protrudes from the remainder of the casing 13 or the inner packet 16, respectively. In this way, when the seam 23 is formed, no forces are exerted on the contents of the packet 10 or the cigarettes 11, respectively.

Another particularity lies in that a groove 40 is applied together with the application of the seam 23 or the transverse seam, respectively. The groove 40 runs parallel to the seam 23, specifically on that side of the seam 23 that faces the inner packet 16.

In the present case, the groove 40 is applied by the crimping device 37 or the crimping rolls 39, respectively. To this end, the crimping rolls 39 have a corresponding groove protrusion 41 or a corresponding groove depression 42, respectively.

Figure 8:
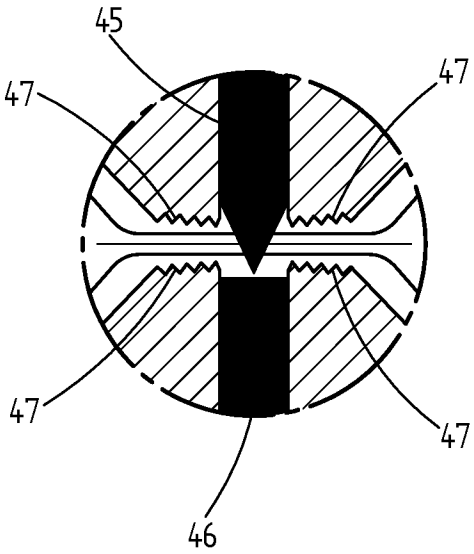
FIG. 8 shows an enlarged detail of the illustration according to FIG. 7.
Figure 7:
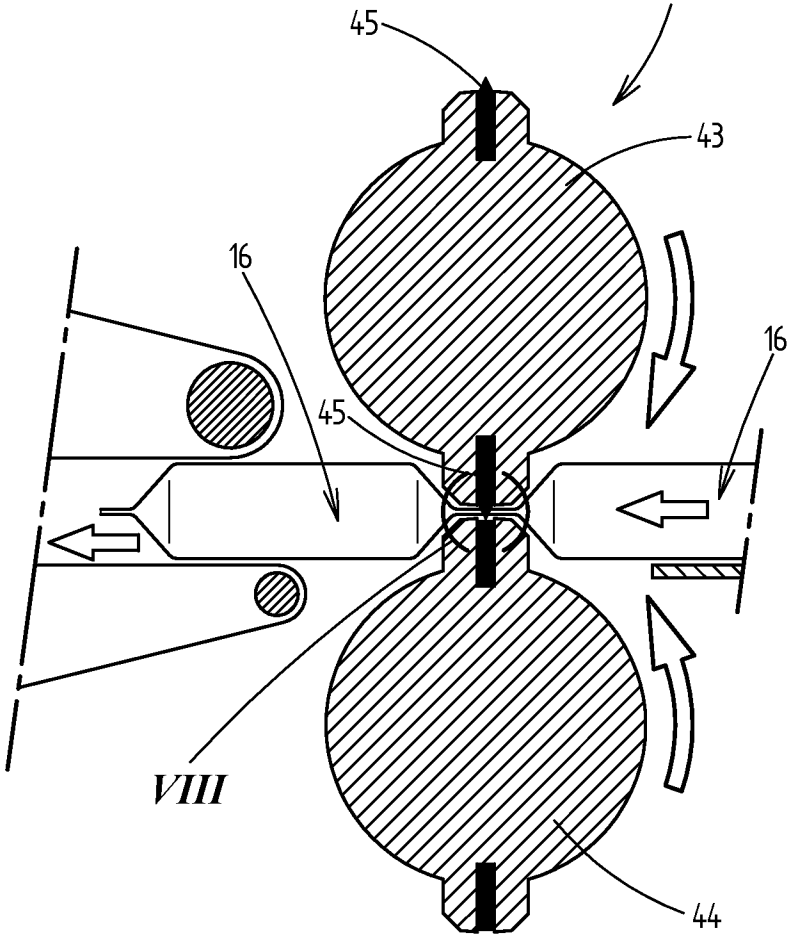
FIG. 7 shows a vertical section through the device according to FIG. 4 along the section line VII-VII in FIG. 4.

FIGS. 7 and 8 show the singularization of the inner packets 16 in the separating station 38. Rotating rollers here are disposed on both sides of the packet web. A first roller 43 possesses separating blades 45 which are disposed on the circumference of the roller 43 and which collaborate with a counterpart 46 on the counter roller 44 in order to sever the packaging material between the groups 12. The counterpart 46 on the counter roller 44 can be configured like the separating blade 45 or as a simple block on which the separating blade 45 comes to bear in order to sever the packaging material.

Crimping tools 47, by way of which the provisional seams 23 are applied, are disposed on both sides of the separating blade 45 or the counterpart 46, respectively.

Figure 9:
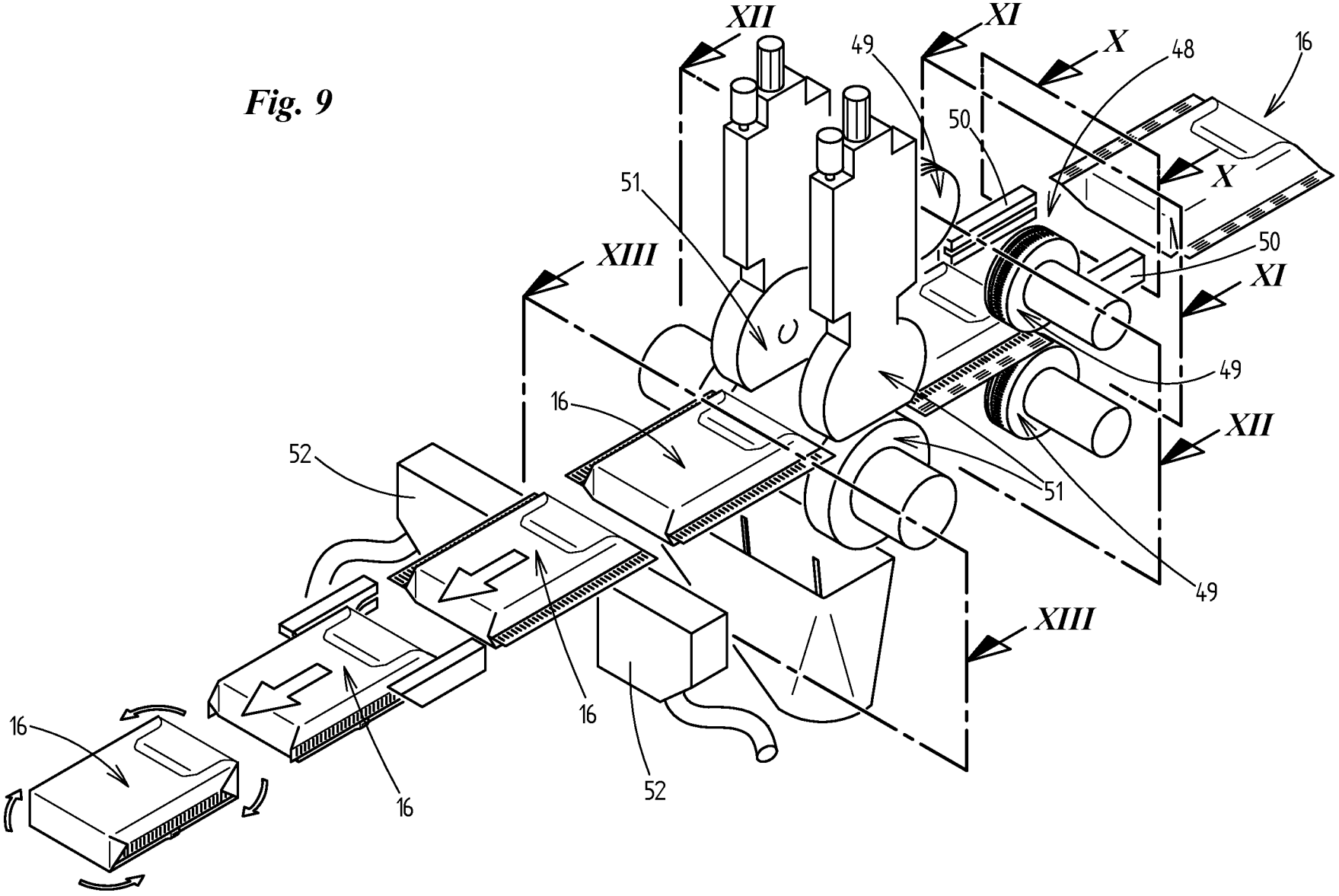
FIG. 9 shows a more detailed illustration of a second portion of the production process.

FIGS. 9 and 13 show the second part of a potential implementation of the production method in terms of plant engineering. Here, after being rotated by 90°, the inner packets 16 are transported by way of the base side 20 first and moved through a longitudinal crimping station 48. In the longitudinal crimping station 48, two pairs of crimping rolls 49, by way of which the final longitudinal seams are applied parallel to the provisional longitudinal seams, are disposed on both sides of the inner packets 16, The crimping rolls 49 are configured in a manner analogous to that of the crimping rolls 39, thus also have means for applying a groove 40.

Disposed upstream of the crimping rolls 49 are guides 50, by way of which the provisional longitudinal seams are fed to the crimping rolls 49 in a precisely positioned manner.

FIG. 12 shows that separating blades 51, by way of which the material strips 32 are severed, are provided on both sides of the inner packets 16, above and below the packet web. FIG. 13 shows a gluing apparatus 52, which is disposed so as to be adjacent to the packet web and by way of which glue portions 53 can be dispensed against a narrow side 19 of the inner packet 16 in order to secure the longitudinal seams in their position after they have been folded over. Such a gluing apparatus 52 is also disposed on the other side of the packet web in order to dispense glue portions 53 against the other narrow side 19 of the inner packet 16 (FIG. 12). Both gluing apparatuses 52 are disposed below the fin seams.

As a further particularity, it is provided that the packaging material is composed of a paper web. A pure paper web is preferably provided as the packaging material. However, it is also conceivable that the packaging material is configured in such a way that (at least) the side facing the package contents is composed of paper. It is also conceivable that the paper web is fully or partially treated in order to increase the tightness, in particular in relation to moisture, for example by using a coated paper web.

As a result, with the aid of the method described, an aroma-tight or moisture-tight packet 10 can be produced, the seams 23 of which are formed exclusively by crimping the packaging material as a fin seam. In the context of the invention, it is also conceivable that individual seams 23 are produced in a different way, but the exclusive formation of the seams by crimping is preferred.

Further particular measures are explained hereunder by means of FIGS. 14 and 15. FIG. 14 herein shows a lateral region of an inner packet 16. The profiles of the individual seams 23 are illustrated.

The provision longitudinal seam can be seen externally on the overlap region of the folding tabs. Since the provisional longitudinal seam does not have to guarantee a permanent closure of the casing 13, the individual crimping areas are disposed at a mutual spacing. The final longitudinal seam, in which the individual crimping regions are disposed close to one another, runs parallel to this in order to ensure a tight closure of the casing 13 in the region of the seam 23.

The groove 40, which is used to fold over the seam region, can be seen directly next to the final longitudinal seam. The separation cut 54 runs between the two longitudinal seams.

In an intersection region 55, the longitudinal seams intersect the transverse seam in the region of the rear side 18. In particular in FIG. 5, it can be seen that the transverse seam is folded against the casing 13 and also extends into the region of the provisional and final longitudinal seam. Since the transverse seam is folded before the longitudinal seams are formed, four plies of the packaging material have to be penetrated during crimping in the overlap region of the transverse seam with the longitudinal seams. The two plies of the transverse seam are also already crimped here. Under certain circumstances, this can lead a defective seam configuration. The applicant has recognized this and has therefore developed several solutions to this problem:

A first solution according to FIG. 14*a* is such that a crossing of the longitudinal and transverse seams is avoided. It is accordingly provided there that the transverse seam ends shortly before the longitudinal seams.

According to FIG. 14*b*, it is provided that the longitudinal seams have crimping regions with larger spacings, so that the longitudinal seams are modified accordingly. This can be sufficient to avoid damaging the packaging material in the seam region or to ensure sufficiently tight seams, respectively.

FIG. 14*c* takes a different path. There, recesses 56 are formed in the folding tabs in order to reduce the number of plies. FIGS. 15*a* and 15*b* show that it is possible to reduce in this way the number of plies to be connected to two or three.

FIG. 16 shows a section through two plies of the packaging material in a region of a crimp.

Figure 17:
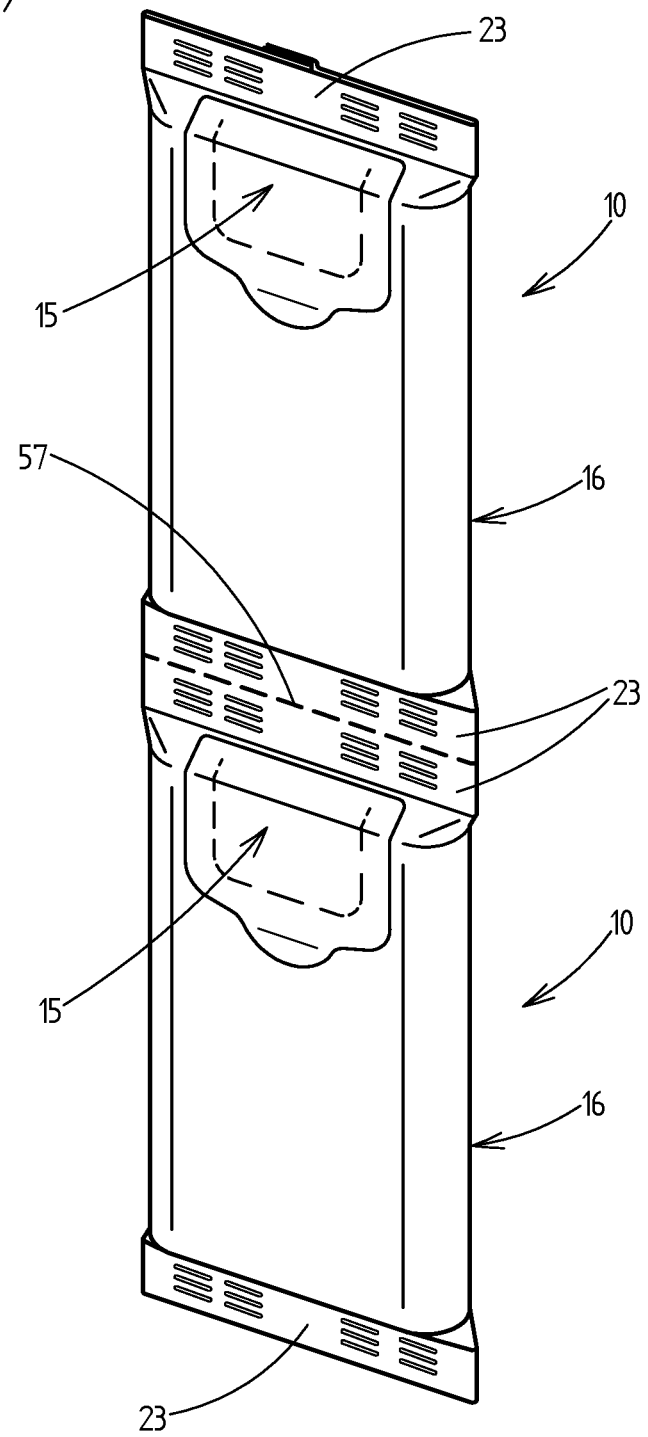
FIG. 17 shows an alternative packet.

FIG. 17 shows a second variant of packets 10 for products. Two packets 10 here are connected to one another in the region of a perforation line 57. The disposal of the seams 23 is provided so as to be somewhat different from the first exemplary embodiment, specifically having two transverse seams in the region of the base side 20 and the front side 21, and one longitudinal seam across the rear side 18 of the packets 10. As in the first exemplary embodiment, a closure means 15 is provided. The packets 10 can be manufactured in a manner similar to the packets 10 of the first exemplary embodiment. In order to form the perforation line 57, it can be provided that the roller 43 and the counter roller 44, in addition to the separating blades 45 and the counterparts 46, have further elements for applying the perforation lines 57. Packets 10, in which more than two packets are connected by perforation lines 57 in a packet strand, are also conceivable.

Figure 19:
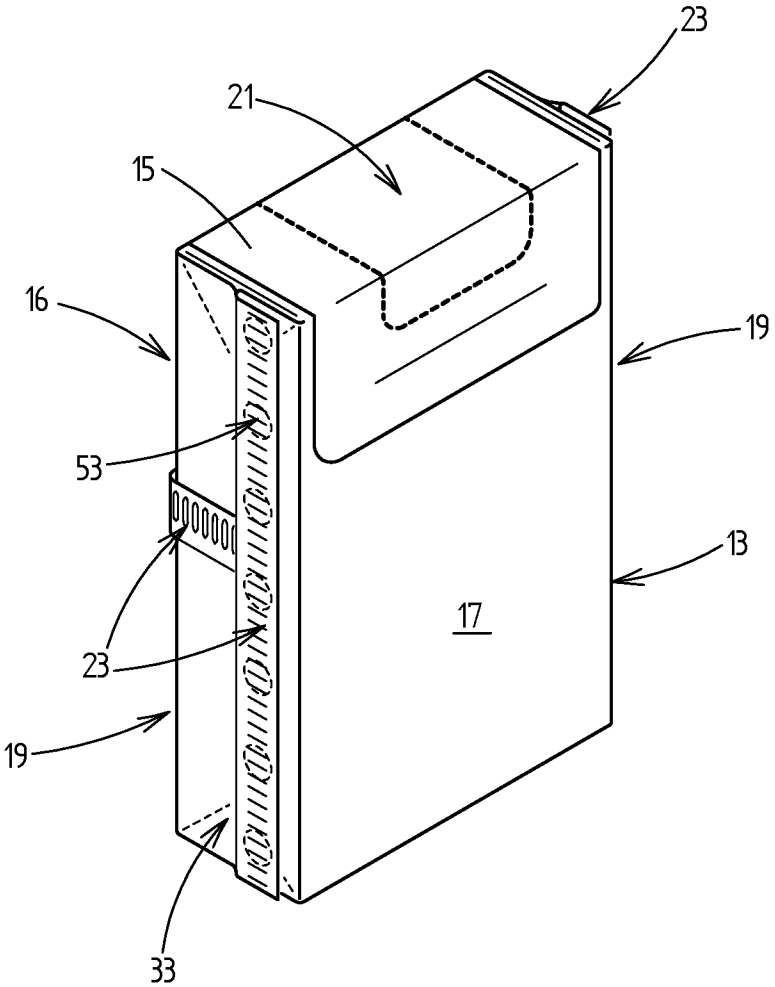
FIG. 19 shows a group of cigarettes in a casing.
Figure 18:
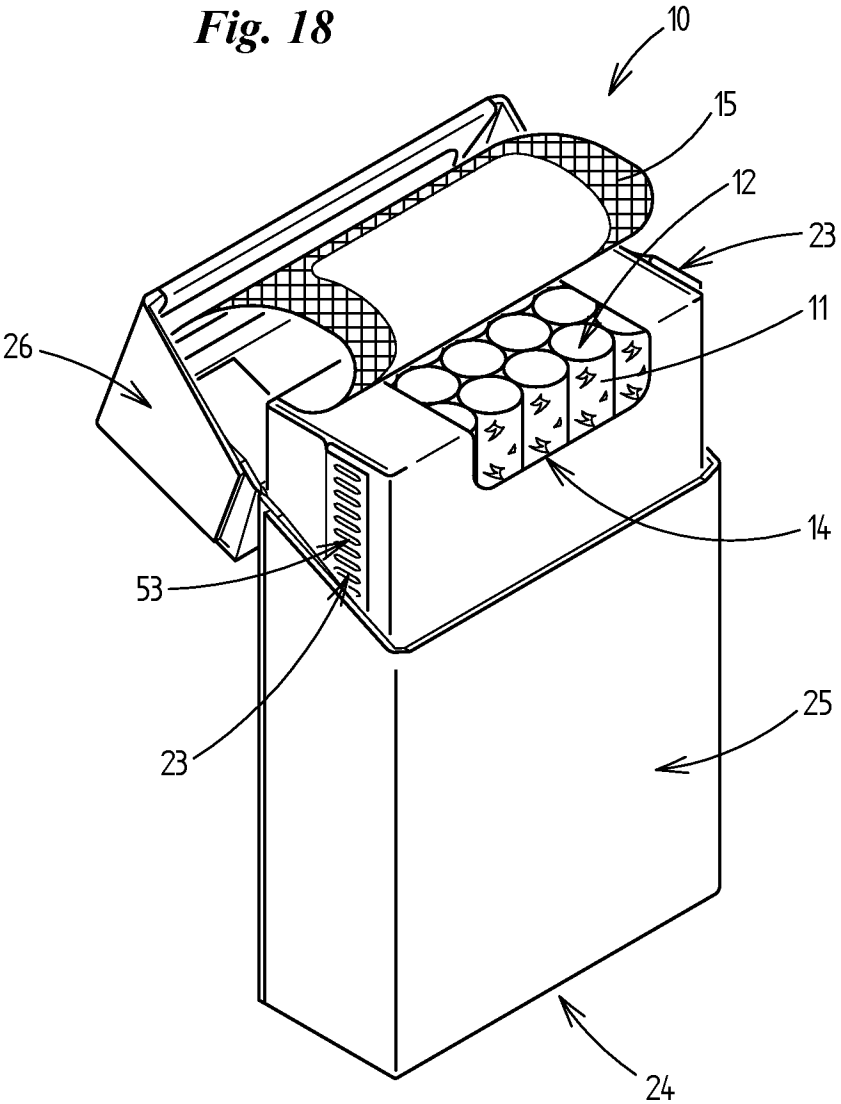
FIG. 18 shows a further alternative packet for cigarettes, having an opened lid.

FIGS. 18 and 19 show a variant of the packet 10 or casing 13, respectively, shown in FIGS. 1 and 2. First of all, it is noticeable that, in the exemplary embodiment shown in FIGS. 18 and 19, the collar 27 shown in the exemplary embodiment according to FIGS. 1 and 2 is absent.

The omission of the collar 27 can be for reasons of sustainability, for example, in that the material consumption in the production of the packets 10 is reduced. Of course, this also leads to a reduction in the manufacturing costs of the packet 10.

The closing procedure of the lid 26 is problematic when a collar 27 is omitted. The applicant has recognized that, during the closing of the lid 26, it can arise that the lateral walls of the lid 26 collide with the seams 23 of the casing 13 that are turned over backward if they are not held by a collar 27 on the narrow sides 19 of the casing 13.

To solve this problem, it is proposed to turn over the seams 23 in the region of the narrow sides 19 of the casing 13 in the direction of the front side 17 and to connect them to the narrow sides 19 of the casing 13 before the casing 13 is inserted into a packet 10. It is achieved as a result that the lateral walls of the lid 26 can slide past the seams 23 of the casing 13 in the region of the narrow sides 19 when closing the lid 26. The connection between the seams 23 and the casing 13 can serve to overcome the restoring forces of the turned-over seams 23. A hot-melt gluing 53 (hot glue track or glue point) could be used to this end, for example. In order to apply this gluing 53, the position of the gluing apparatuses 52 must be adapted accordingly, as shown by way of example in FIG. 13, so that gluing apparatuses 52 are disposed on both sides of the packet web above the fin seams.

LIST OF REFERENCE SIGNS

10 Packet
11 Cigarette
12 Group
13 Casing
14 Retrieval opening
15 Closure means
16 Inner packet
17 Front side
18 Rear side
19 Narrow side
20 Base side
21 End side
22 Folding tab
23 Seam
24 Outer packet
25 Box part
26 Lid
27 Collar
28 Tray
29 Arrow
30 Material web
31 Arrow
32 Material strips
33 Ear
34 Conveying installation
35 Forming shoulder
36 Contact pressure element
37 Crimping installation
38 Separating station
39 Crimping roll
40 Groove
41 Groove protrusion
42 Groove depression
43 Roller
44 Counter roller

45 Separating blade
46 Counterpart
47 Crimping tool
48 Longitudinal crimping station
49 Crimping roll
50 Guide
51 Separating blade
52 Gluing apparatus
53 Glue portion
54 Separation cut
55 Intersection region
56 Recess
57 Perforation line
58 Ventilation hole

The invention claimed is:

1. A packet (10) for cigarette industry products, having a casing (13) which, preferably on all sides, surrounds a group (12) of cigarette industry products as the packet content, wherein the casing (13) is formed from a packaging material having folding tabs, wherein the folding tabs of the packaging material are connected to one another by seams (23), wherein at least two of the folding tabs of the packaging material at least partially overlap each other in overlap regions;

wherein at least one of the seams (23) is formed by crimping the folding tabs of the packaging material that bear on one another in the overlap regions of those of the folding tabs that bear on one another so as to form crimps, and wherein the crimps are disposed so that the crimps do not intersect grooves (40) applied in the overlap regions of the folding tabs such that the crimps end before each of the grooves (40) and the crimps are interrupted in the region of each of the grooves (40).

2. The packet as claimed in claim 1, wherein the seams (23) are formed exclusively by crimping.

3. The packet as claimed in claim 1, wherein the seams (23) that are formed by crimping are configured as fin seams.

4. The packet as claimed in claim 1, wherein the casing (13) has a large-area front side (17), a corresponding, opposite, large-area rear side (18), narrow sides (19) which connect the front side (17) and the rear side (18) to one another, as well as a base side (20) and an opposite end side (21), wherein the base side (20) and the end side (21) are in each case adjacent to the front side (17), the rear side (18) and the narrow sides (19).

5. The packet as claimed in claim 4, wherein one of the seams (23), namely a transverse seam of the casing (13), runs across the front side (17) or the rear side (18) of the casing (13) so as to be directed transversely to a longitudinal axis of the casing (13).

6. The packet as claimed in claim 5, wherein another one of the seams (23), namely a longitudinal seam of the casing (13), runs in each case along the narrow sides (19) of the casing (13) so as to be directed parallel to a longitudinal axis of the casing (13).

7. The packet as claimed in claim 6, wherein the longitudinal seam is folded in the region of narrow sides (19) of the casing (13) in the direction of a front side (17) or a rear side (18) of the casing (13).

8. The packet as claimed in claim 7, wherein, in casings (13) having seams (23) folded in the direction of a front side (17), the packet (10) in the region of narrow sides (19) of the casing (13) does not have a collar (27) and the folded-over seams (23) are fastened to the casing (13) by adhesive bonding in order to avoid a collision between a lid (26) of the packet (10) and the folded-over seams (23) when closing the lid (26).

9. The packet as claimed in claim 1, wherein the grooves (40) are applied parallel to the seams (23).

10. The packet as claimed in claim 9, wherein each of the grooves (40) extend parallel to a neighboring one of the seams (23) and each of the grooves are disposed on that side of the neighboring one of the seams (23) that faces the package content.

11. The packet as claimed in claim 1, wherein the seams (23) are disposed in such a manner that the number of folding tabs that bear on one another in the overlap regions and are to be connected to one another by crimping is limited to fewer than 5 of the folding tabs.

12. The packet as claimed in claim 1, wherein at least a portion of the seams (23) have an intersecting profile in an intersection region (55) of the seams (23) that at least in part has an interruption in one or more of the seams (23) such that the seams (23) do not overlap with the crimps in the intersection region (55).

13. The packet as claimed in claim 12, wherein, in the overlap region of the folding tabs, the crimps are interrupted along a portion of the seams (23), and in that these interruptions of the crimps are disposed in the intersection region (55) such that the crimps do not overlap with the seams (23) in the intersection region (55).

14. The packet as claimed in claim 12, wherein the crimps are modified in the overlap region of the folding tabs, namely in terms of a density of the crimps and/or an alignment of the crimps, and in that correspondingly modified portions of the crimps are disposed in the intersection region (55).

15. The packet as claimed in claim 1, wherein regions of the packaging material that face the packet content are composed exclusively of paper, or in that the packaging material is composed exclusively of paper.

16. The packet as claimed in claim 1, wherein the seams (23) are disposed in such a manner that the number of folding tabs that bear on one another in the overlap regions and are to be connected to one another by crimping is limited to fewer than 4 plies.

* * * * *